US005568155A

United States Patent [19]

Tsunekawa et al.

[11] Patent Number: 5,568,155

[45] Date of Patent: Oct. 22, 1996

[54] ANTENNA DEVICES HAVING DOUBLE-RESONANCE CHARACTERISTICS

[75] Inventors: Koichi Tsunekawa; Seiji Hagiwara, both of Yokosuka, Japan

[73] Assignee: NTT Mobile Communications Network Incorporation, Tokyo, Japan

[21] Appl. No.: 284,494

[22] PCT Filed: Dec. 7, 1993

[86] PCT No.: PCT/JP93/01770

§ 371 Date: Nov. 7, 1994

§ 102(e) Date: Nov. 7, 1994

[87] PCT Pub. No.: WO94/14210

PCT Pub. Date: Jun. 23, 1994

[30] Foreign Application Priority Data

Dec. 7, 1992 [JP] Japan ..... 4-326998
Jul. 6, 1993 [JP] Japan ..... 5-167115

[51] Int. Cl.[6] ..... H01Q 1/38

[52] U.S. Cl. ..... 343/700 MS; 343/830; 343/846

[58] Field of Search ..... 343/700 MS, 829, 343/830, 831, 848, 846; H01Q 1/38

[56] References Cited

U.S. PATENT DOCUMENTS 4,123,758 10/1978 Shibano et al. ..... 343/830
5,410,323 4/1995 Kuroda ..... 343/700 MS

FOREIGN PATENT DOCUMENTS 58-6405 2/1983 Japan .
61-41205 2/1986 Japan .
62-279704 12/1987 Japan .
2-60083 12/1990 Japan .
3-80603 4/1991 Japan .

OTHER PUBLICATIONS

English Abstract of Japanese Kokai 52–106661 Jul. 1977.

English Abstract of Japanese Kokai 3–80603 Apr. 1991.

James et al "A Dual–Frequency Patches", Handbook of Microstrip Antennas 1989, p. 50 No month.

Antenna Systems, Air Force Manual No. 52—19, Jun. 1953, pp. 55–61.

*Primary Examiner*—Hoanganh T. Le
*Attorney, Agent, or Firm*—Cushman, Darby & Cushman

[57] ABSTRACT

Double-resonance characteristics are obtained with a small and simple construction by arranging a conductive planar radiation element approximately parallel to a conductive ground plane with an intermediary insulator, connecting a feed line to these, and further connecting a parasitic line to a separate contact point at a distance from the contact point of the feed line.

6 Claims, 11 Drawing Sheets

ANTENNA DEVICES HAVING DOUBLE-RESONANCE CHARACTERISTICS

TECHNICAL FIELD

This invention relates to small printed antenna devices which resonate at two resonant frequencies. This invention is particularly suitable for utilization as a built-in antenna for a small portable radio unit.

BACKGROUND TECHNOLOGY

Known examples of antenna devices which resonate at two resonant frequencies include the planar inverted-F antenna disclosed in Japanese Pat. Pub. No. 61-41205 (Pat. Appl. No.59-162690) and microstrip antennas presented in "Handbook of Microstrip Antennas" by J. R. James and P. S. Hall.

FIG. 1 is a perspective view showing the construction of the planar inverted-F antenna disclosed in the above-mentioned application. This prior art example has a first planar radiation element 21 and a second planar radiation element 22, and these are arranged parallel to ground plane 23. The two planar radiation elements 21 and 22 are mutually connected by stub 24, and first planar radiation element 21 and ground plane 23 are connected by stub 25. The non-grounded conductor of feed line 26 is connected to planar radiation element 21 at contact point 27, while the grounded conductor of feed line 26 is connected to ground plane 23. The dimensions $L_1 \times L_2$ of planar radiation element 21 differ from the dimensions $L_3 \times L_4$ of planar radiation element 22, which means that they resonate at different resonant frequencies to give a double resonance. In other words, the planar inverted-F antenna constituted by planar radiation element 21 and the planar inverted-F antenna carried on top of it resonate independently, and are fed by a single feed line 26.

FIGS. 2–4 show examples of three cross-sectional structures of microstrip antennas. In these antennas, first planar radiation element 31 and second planar radiation element 32 are again arranged parallel to ground plane 33, but two feed lines 34 and 35 are connected to these (in the example given in FIG. 4, only feed line 34 is connected). In these cases as well, the size and structure of the two planar radiation elements 31 and 32 are different, and they resonate independently to give a double resonance.

Consequently, the thickness $h_2$ of a conventional double-resonance planar inverted-F antenna has to be approximately twice the thickness $h_1$ of a single planar inverted-F antenna. The disadvantage of the prior art has therefore been that an antenna has to have a larger capacity and a more complicated structure in order to obtain double resonance characteristics.

Conventional double-resonance microstrip antennas have the advantage that the two frequencies can be selected relatively freely, but because structurally they are basically two antennas on top of one another, the disadvantage has again been that the antenna volume is larger and its structure more complicated. A further disadvantage of multiresonant microstrip antennas of the basic type has been their lack of resonance below the first mode resonant frequency.

The purpose of this invention is to solve such problems and to provide an antenna device which, although small and simple in construction, has double resonance characteristics.

DISCLOSURE OF THE INVENTION

The antenna device offered by this invention is characterized in that, in an antenna device which has a conductive ground plane, a conductive planar radiation element arranged approximately parallel to this ground plane with an intermediary insulator, and a feed line with a grounded conductor which is connected to the ground plane and a non-grounded conductor which is connected to the planar radiation element: a parasitic line is connected to another contact point at a distance from the contact point of the feed line, the parasitic line having a grounded conductor connected to the ground plane and a non-grounded conductor connected to the planar radiation element. Given this constitution, the parasitic line constitutes a stub and the antenna device can exhibit double resonance characteristics.

When a line with open ends is used as the aforementioned parasitic line, if $\lambda$ is the resonant wavelength when the points of contact of this parasitic line with the ground plane and the planar radiation element are short-circuited, the electrical length of this parasitic line is made:

$$(1/4+m/2)\lambda$$

where m is an integer equal to or greater than 0.

It is also feasible to provide resonant wavelength tuning slits in edges of the planar radiation element, and to tune the lower of the two resonant frequencies.

It is also feasible to provide a plurality of parasitic lines. In particular, a preferred construction is as follows. Namely, the planar radiation element has a shape such that at least two sides are mutually opposed, and there are provided a first parasitic line with a contact point which is approximately the center of one of these two sides, and second and third parasitic lines with contact points which are respectively the ends of the other of these two sides. If $\lambda$ is the resonant wavelength when the planar radiation element and the ground plane are connected by a short-circuited line instead of by the first parasitic line, and when there are no second and third parasitic lines, the respective electrical lengths of the first parasitic line and the second and third parasitic lines are set so as to be approximately equal to the value given by:

$$(1/4+m/2)\times\lambda$$

where m is an integer which is equal to or greater than 0 and which is established independently for each parasitic line. The terminal of the first parasitic line that is distant from the planar radiation element and the ground plane is opened, while the terminals of the second and third parasitic lines that are distant from the planar radiation element and the ground plane are short-circuited.

Given this construction, at the lower resonant frequency the first parasitic line achieves a short stub between the planar radiation element and the ground plane, while the second and third parasitic lines are opened-circuited. This antenna device will therefore operate as a planar inverted-F antenna. At the higher resonant frequency, the first parasitic line is open-circuited while the second and third parasitic lines perform short stubs between the planar radiation element and the ground plane, so that this antenna device will operate as a quarter-wavelength microstrip antenna. In other words, double resonance characteristics are obtained. Under these circumstances, one of the two resonant frequencies will be approximately twice that of the other.

When this antenna device operates as a quarter-wavelength microstrip antenna, the resonant frequency is determined by the second and third parasitic lines becoming short-circuited lines. Under these circumstances, fine tuning of the resonant frequency will be possible if the first parasitic line is used as an additional impedance. When the device operates as a planar inverted-F antenna, the resonant frequency is determined by the first parasitic line becoming a short stub, so that fine tuning of the resonant frequency will be possible by using the second and third parasitic lines as additional impedances.

Embodiments of this invention will now be explained with reference to the accompanying drawings.

OPTIMUM CONFIGURATIONS FOR EMBODYING THE INVENTION

Figure 1:
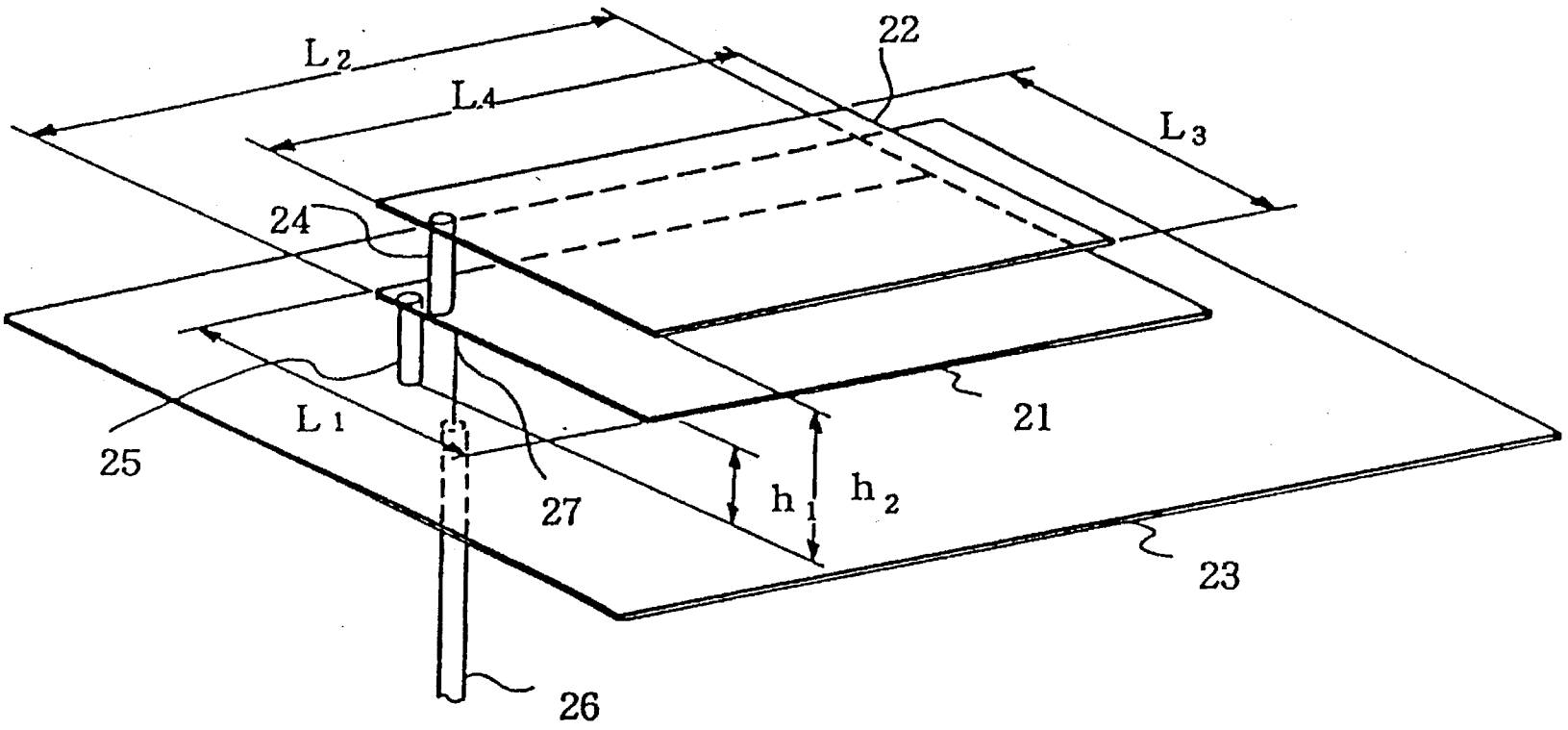
PRIOR ART Figure 1.
FIG. 1 is a perspective view showing the construction of a conventional double-resonance planar inverted-F antenna.
Figure 2:
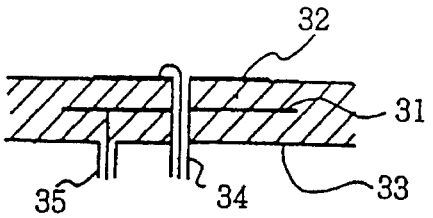
Figure 2. PRIOR ART
FIG. 2 shows the cross-sectional structure of a conventional double-resonance microstrip antenna.
Figure 3:
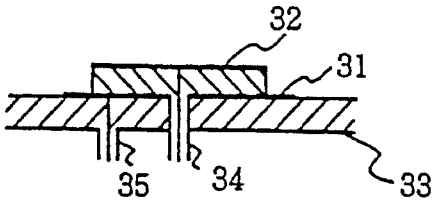
Figure 3. PRIOR ART
FIG. 3 shows the cross-sectional structure of a conventional double-resonance microstrip antenna.
Figure 4:
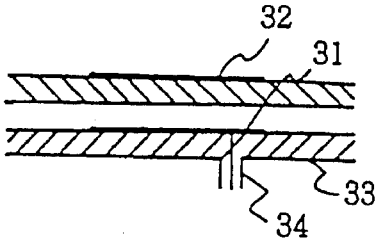
Figure 4. PRIOR ART
FIG. 4 shows the cross-sectional structure of a conventional double-resonance microstrip antenna.
Figure 5:
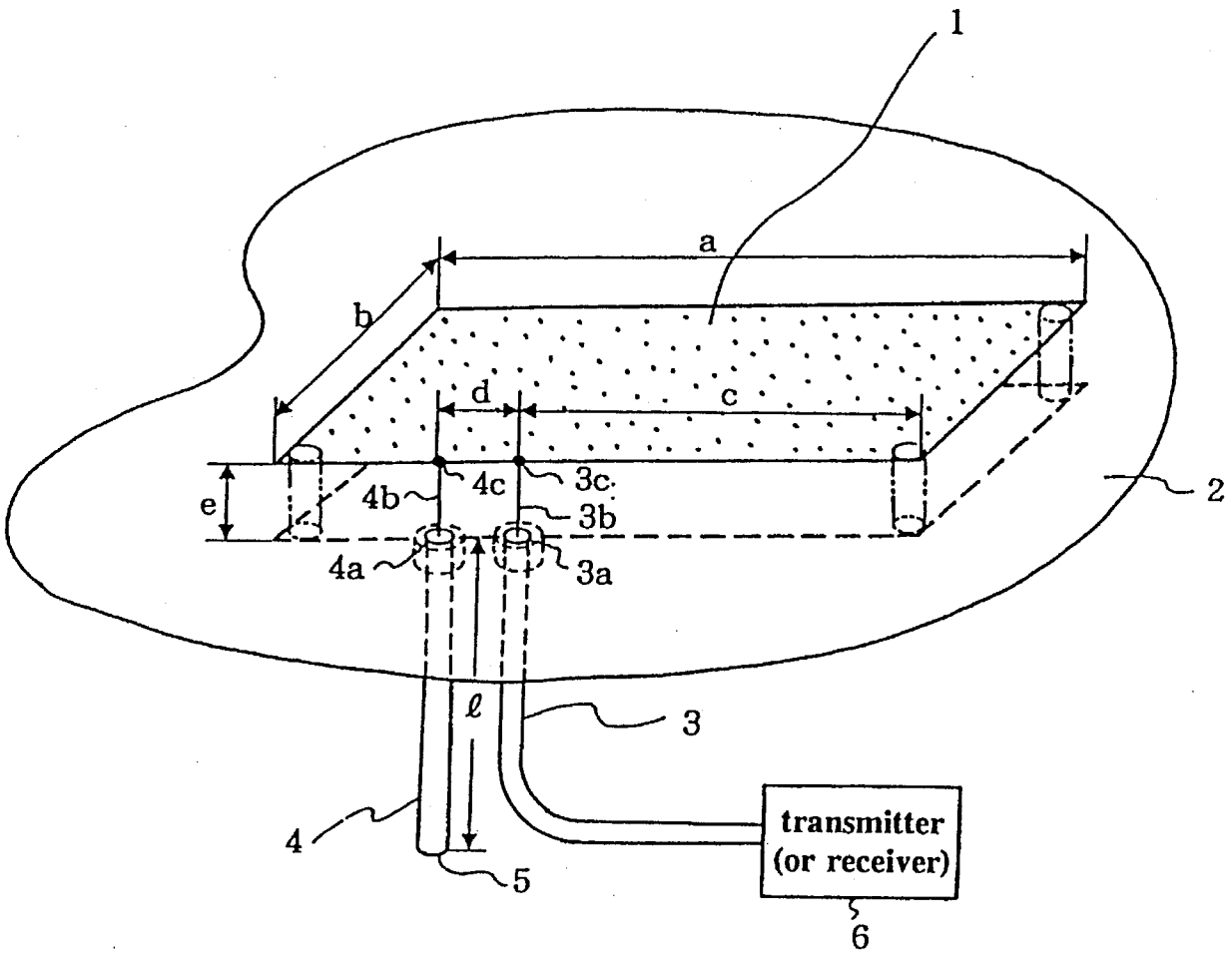
FIG. 5 is a perspective view showing the constitution of a first embodiment of this invention.

FIG. 5 is a perspective view showing the constitution of a first embodiment of this invention. This embodiment has conductive ground plane 2, conductive planar radiation element 1 arranged approximately parallel to this ground plane 2 with an intermediary insulator, and feed line 3 with grounded conductor 3*a* connected to ground plane 2 and non-grounded conductor 3*b* connected to contact point 3*c* of planar radiation element 1. Parasitic line 4 is connected to a separate contact point 4*c* at a distance from contact point 3*c* of feed line 3, the parasitic line 4 having grounded conductor 4*a* connected to ground plane 2 and non-grounded conductor 4*b* connected to planar radiation element 1.

Transmitter or receiver 6 is connected to feed line 3, and terminal 5 of parasitic line 4 is open. If λ is the resonant wavelength when the points of contact of parasitic line 4 with ground plane 2 and planar radiation element 1 are short-circuited, the electrical length of parasitic line 4 will be:

$$(1/4+m/2)\lambda$$

where m is an integer equal to or greater than 0.

Thus constituted, the first embodiment of this invention operates at the lower resonant frequency as a planar inverted-F antenna in which contact point 4*c* of parasitic line 4 achieves a short stub between ground plane 2 and planar radiation element 1; while at the higher resonant frequency it operates as a general microstrip antenna in which ground plane 2 and planar radiation element 1 provide an open-circuit at contact point 4*c* of parasitic line 4. Under these circumstances, one of the two resonant frequencies will be approximately twice that of the other.

Figure 6:
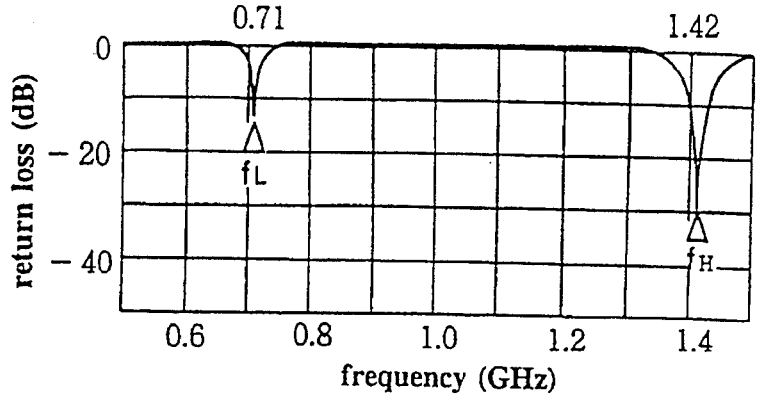
FIG. 6 gives an example of the results of measurement of the return loss characteristics of the first embodiment.
Figure 7:
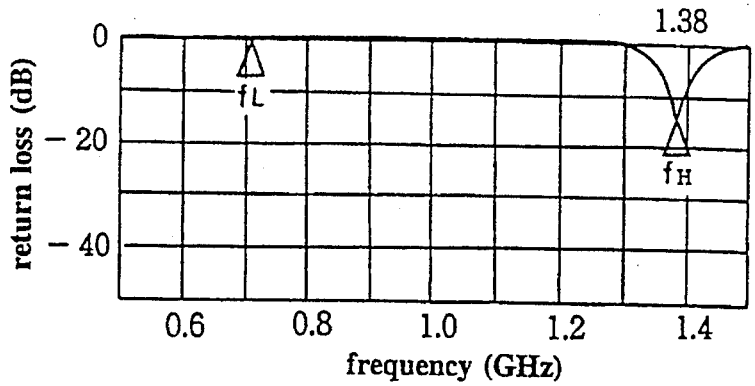
FIG. 7 shows the measured return loss characteristics when the parasitic line is not connected.
Figure 8:
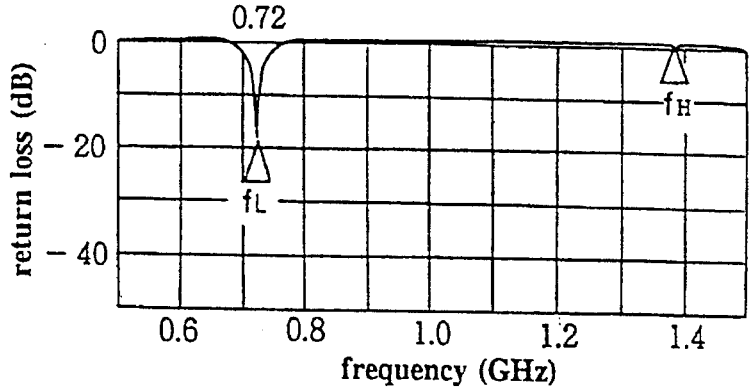
FIG. 8 shows the measured return loss characteristics when the parasitic line is changed for a short-circuited metal line.

FIG. 6–FIG. 8 show examples of the results of measurement of return loss characteristics. Return loss is defined in terms of the characteristic impendence $Z_0$ of the feed line and the impendence Z of the antenna, as:

$$20\log_{10}\left|\frac{Z-Z_0}{Z+Z_0}\right|$$

and is expressed in decibel units. Ground plane 2 used in these measurements was 330 mm×310 mm, and planar radiation element 1 had a×b=100 mm×23 mm (see FIG. 5). FIG. 6 gives the results of measurements obtained when feed line 3 was connected at a point c=68 mm from a corner of the longer side of planar radiation element 1, and when parasitic line 4 was connected at d=3 mm farther from that corner, and when the length l of parasitic line 4 was 60 mm and terminal 5 was open. In these results, the lower resonant frequency $f_L$ is 0.71 GHz and the higher resonant frequency $f_H$ is 1.42 GHz, so that $f_H$ is twice $f_L$. As opposed to this, the results of measurements made without parasitic line 4 connected are given in FIG. 7. In this case, a resonance point appears at a frequency approximately equal to the higher resonant frequency $f_H$ shown in FIG. 6, while the antenna exhibits no resonance at all at the lower resonant frequency $f_L$. The results of measurements performed when parasitic line 4 was made into a short-circuited metal line are given in FIG. 8. In this case, a resonance point appears at a frequency approximately equal to the lower resonant frequency $f_L$ shown in FIG. 6, and no resonance at all is exhibited at the higher resonant frequency $f_H$.

Figure 9:
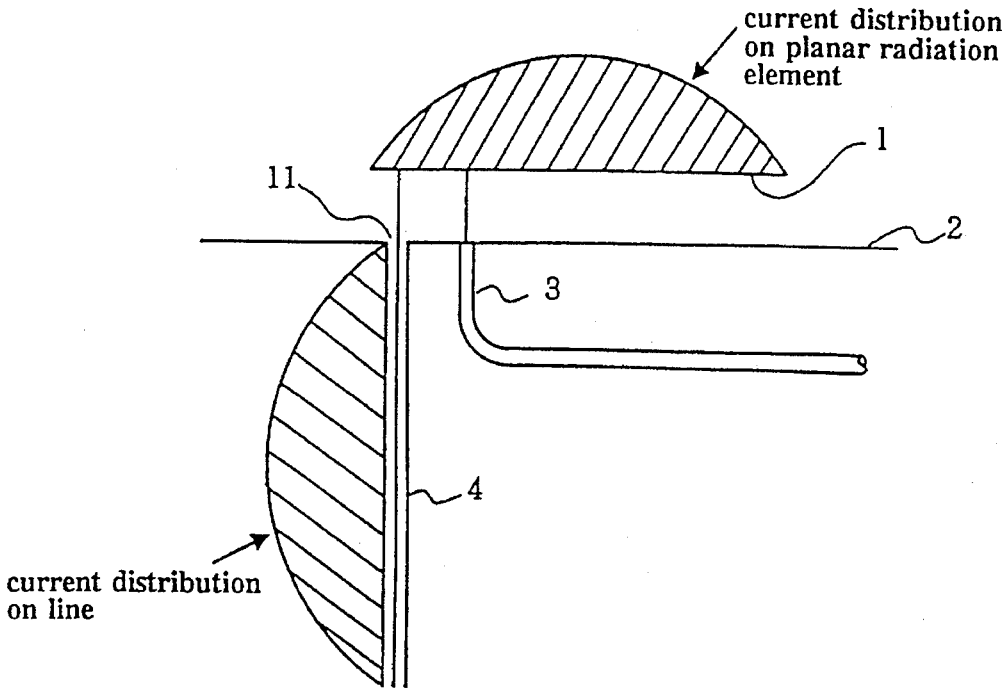
FIG. 9 shows the current distribution on the planar radiation element and within the parasitic line at the higher resonant frequency $f_H$.
Figure 10:
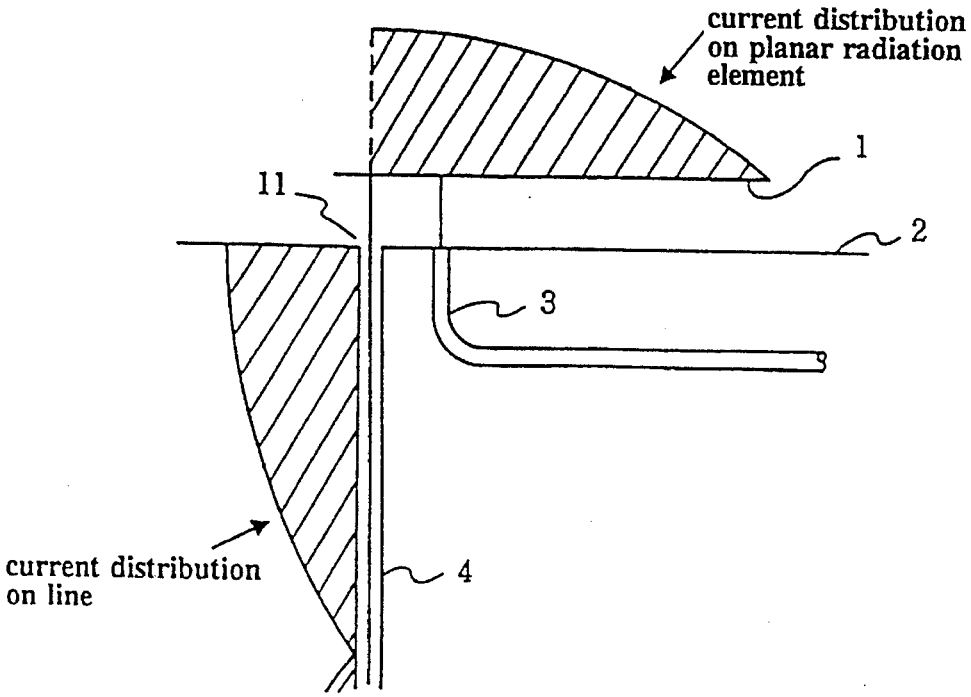
FIG. 10 shows the current distribution on the planar radiation element and within the parasitic line at the lower resonant frequency $f_L$.

From these results it will be seen that parasitic line 4 operates as a short-circuited metal line at the lower resonant frequency $f_L$ and as an open-circuit (i.e., as if nothing were connected) at the higher resonant frequency $f_H$. FIG. 9 and FIG. 10 show this in terms of current distributions. FIG. 9 shows current distribution on planar radiation element 1 and current distribution in the non-grounded conductor inside parasitic line 4 at the higher resonant frequency $f_H$, while FIG. 10 shows these current distributions at the lower resonant frequency $f_L$.

At the higher resonant frequency, as shown in FIG. 9, there is a 1/2 wavelength current distribution on planar radiation element 1, as in a general microstrip antenna, and a 1/2-wavelength current distribution within parasitic line 4 as well. Because these current distributions form, parasitic line 4 becomes a 1/2-wavelength open-end line and operates as an open-circuit at contact point 11 of parasitic line 4 as well, with the result that the antenna operates as a general microstrip antenna without relation to parasitic line 4. Under these conditions, because the grounded conductor of parasitic line 4 is in the periphery and has an opposing current, the current in the non-grounded conductor within parasitic line 4 does not radiate at all and does not hinder the operation of the antenna.

On the other hand, at the lower resonant frequency, because the wavelength is doubled, there is a 1/4-wavelength current distribution on planar radiation element 1 and a 1/4-wavelength current distribution forms within parasitic line 4 as well, as shown in FIG. 10. Because these current distributions form, parasitic line 4 becomes an approximately 1/4-wavelength open-end line and operates as a short circuit at contact point 11 of parasitic line 4. In other words, this antenna constitutes a planar inverted-F antenna short-circuited at the contact points of parasitic line 4 with planar radiation element 1 and ground plane 2. In this case as well, the current within parasitic line 4 does not radiate at all and does not hinder the operation of the antenna.

Because a general microstrip antenna will resonate when the length of the planar radiation element becomes approximately a half wavelength, the resonant frequency of a microstrip antenna with a planar radiation element of length $\alpha$=100 mm can be calculated to be 1.5 GHz, and this is close to the value of the higher resonant frequency $f_H$ shown in FIG. 6. On the other hand, because a general planar inverted-F antenna will resonate when the sum of the length and breadth of the planar radiation element comes to approximately a quarter wavelength, then assuming that the remainder of planar radiation element 1 from the contact point of parasitic line 4 is the actual planar radiation element (see FIG. 5), the resonant frequency of a planar antenna where the sum of its length and breadth b+c+d=94 mm can be calculated to be 0.79 GHz, which is close to the value of the lower resonant frequency $f_L$ shown in FIG. 6.

The electrical length of parasitic line 4 is not restricted to approximately a quarter of the wavelength of the lower resonant frequency, and the same antenna operation can be obtained if the electrical length is 3/4, 5/4, . . . 1/4+m/2 (where m is an integer).

In addition, neither the contact points of feed line 3 and parasitic line 4 nor the shape of planar radiation element 1 are restricted to those shown in this embodiment, and provided that parasitic line 4 is short-circuited at the lower frequency and becomes open at the higher frequency, other feed lines, parasitic lines, contact methods and planar radiation element shapes may be considered, and it will be possible to obtain, by means of a simple construction, an antenna which also resonates at approximately twice the resonant frequency of the planar inverted-F antenna which operates at the lower resonant frequency, despite having virtually the same volume.

Figure 11:
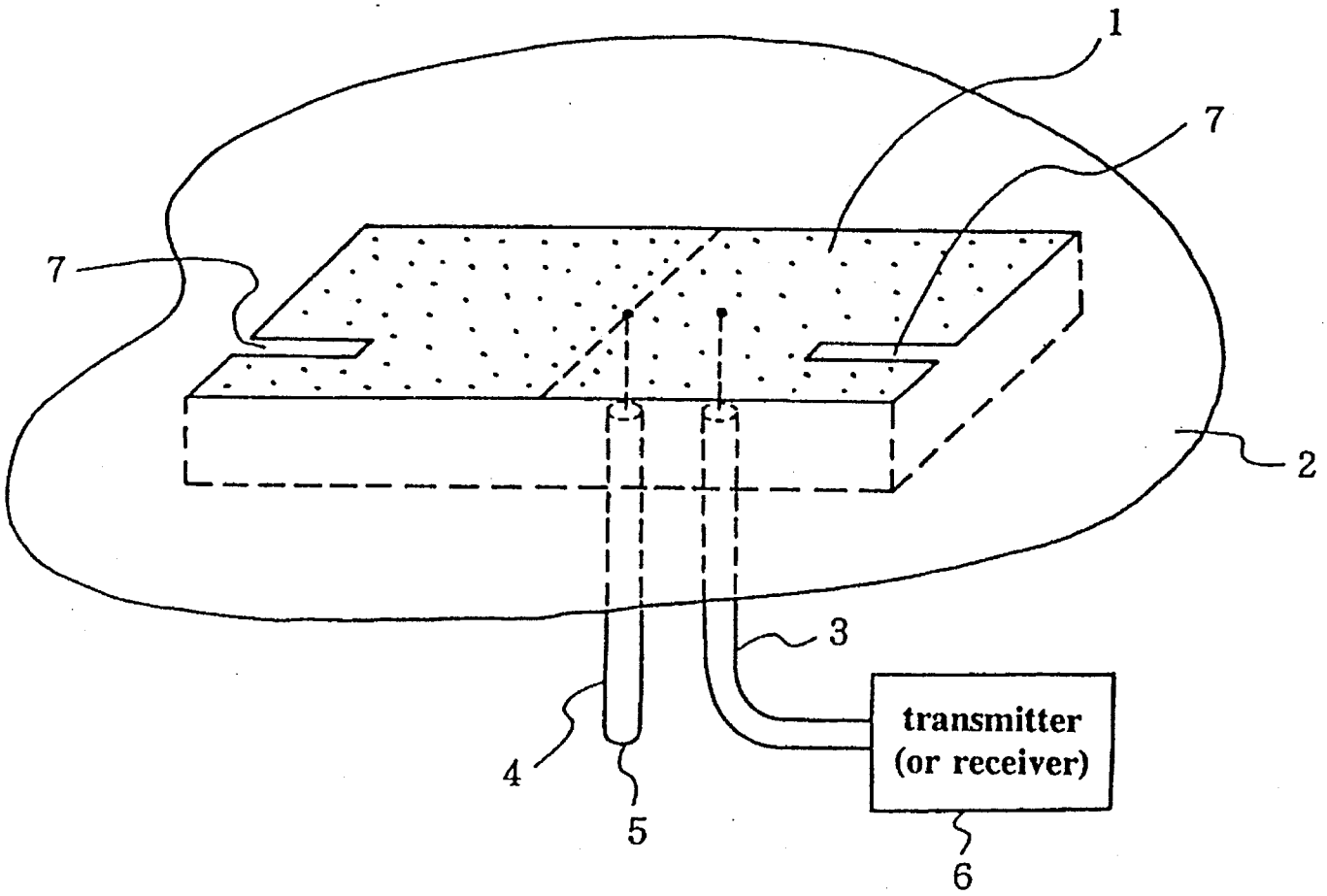
FIG. 11 is a perspective view showing the constitution of a second embodiment of this invention.

FIG. 11 shows the constitution of a second embodiment of this invention. This embodiment differs from the first embodiment in that linear slits 7 have been provided in planar radiation element 1 in the longer direction. Given this constitution, parasitic line 4 becomes open at the higher frequency and short-circuited at the lower frequency. Consequently, at the higher frequency, planar radiation element 1 operates as a microstrip antenna, and the resonant frequency is related to the length of the longer direction. Under these circumstances, there will be a current distribution in the longer direction only, and although linear slits 7 are provided in this direction, they have no effect on the resonant frequency. On the other hand, at the lower frequency this antenna device operates as a planar inverted-F antenna, and the resonant frequency is related to the length of the periphery of planar radiation element 1. It follows that this resonant frequency can be adjusted by means of the length of linear slits 7, so that it becomes possible to move the lower resonant frequency.

Figure 12:
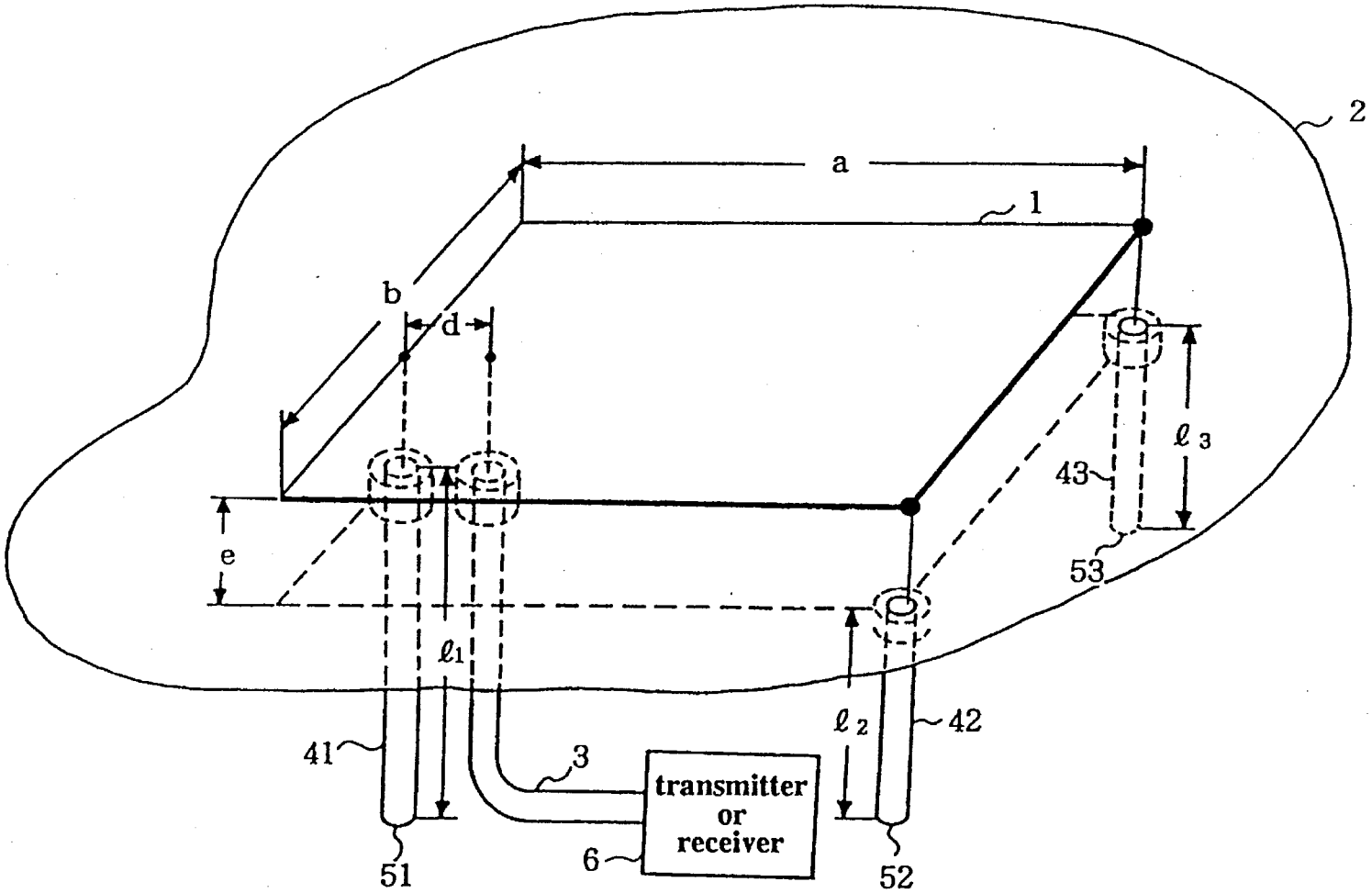
FIG. 12 is a perspective view showing the construction of an antenna device according to a third embodiment of this invention.

FIG. 12 shows the construction of an antenna device according to a third embodiment of this invention. This antenna device has planar radiation element 1 with a shape such that at least two sides are mutually opposed (in this embodiment, it is a square), ground plane 2 arranged substantially parallel to this planar radiation element 1, and feed line 3 with one conductor connected to planar radiation element 1 and the other conductor connected to ground plane 2. A transmitter or a receiver 6 is connected to the other end of feed line 3.

The distinguishing feature of this embodiment is as follows. Namely, it has first parasitic line 41 with a non-grounded conductor which is connected to approximately the center of one of the two mutually opposing sides of planar radiation element 1, and a grounded conductor which is connected to ground plane 2. It also has a second and a third parasitic line 42 and 43 with non-grounded conductors which are respectively connected to the corners of the side of planar radiation element 1 which opposes the side on which parasitic line 41 is provided, and with grounded conductors which are connected to ground plane 2. If $\lambda$ is the resonant wavelength when planar radiation element 1 and ground plane 2 are connected by a short-circuited line instead of by parasitic line 41, and when parasitic lines 42 and 43 are not present, the respective electrical lengths of parasitic lines 41, 42 and 43 are set so as to be approximately equal to the value given by:

$$(1/4+m/2)\times\lambda$$

where m is an integer equal to or greater than 0 and which is established independently for each parasitic line 41–43. Terminal 51 at the end of parasitic line 41 which is distant from planar radiation element 1 and ground plane 2 is open-circuited while terminals 52 and 53 at the ends of parasitic lines 42 and 43 which are distant from planar radiation element 1 and ground plane 2, are short-circuited.

Given this construction, at the lower resonant frequency the contact point of parasitic line 41 operates as a short stub between planar radiation element 1 and ground plane 2, while plainer radiation element 1 and ground plane 2 are both open-circuit at the contact points of parasitic lines 52 and 53, whereupon this embodiment operates as a planar inverted-F antenna. At the higher resonant frequency, planar radiation element 1 and ground plane 2 achieve an open-circuit at the contact point of parasitic line 41, and the contact points of parasitic lines 52 and 53 become stubs which short-circuit planar radiation element 1 and ground plane 2, whereupon this device operates as a quarter-wavelength microstrip antenna. Under these circumstances, one of the two resonant frequencies will be approximately twice that of the other.

Figure 13:
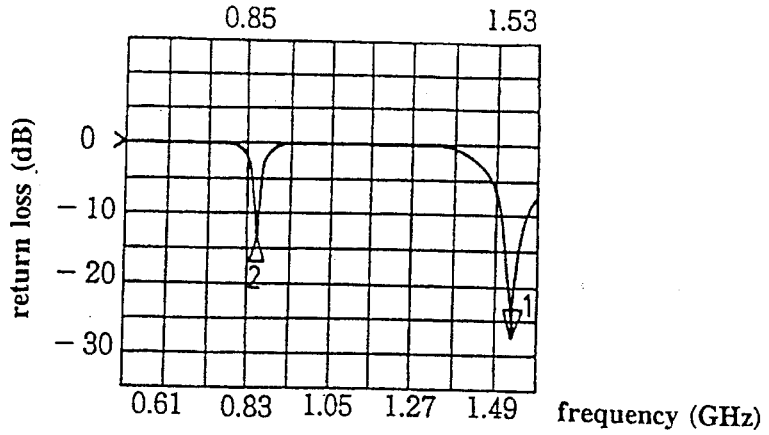
FIG. 13 gives an example of the results of measurement of the return loss characteristics of the third embodiment.

FIG. 13 shows the results of measurements of the return loss characteristics of an experimental antenna device. These measurements were made on a device with the construction illustrated in FIG. 12, and with the following dimensions:

length and breadth of planar radiation element 1: a×b=40×40 mm dimensions of ground plane 2: 500×500 mm contact position of parasitic line 41: center of one side of planar radiation element 1 contact position of feed line 3: a point on a line at right-angles to the side of planar radiation element 1 on which parasitic line 41 is connected, and at a distance d=2 mm from the point at which parasitic line 41 is connected gap e between planar radiation element 1 and ground plane 2: 10 mm length $l_1$ of parasitic line 41: 50 mm length $l_2$ of parasitic line 42: 60 mm length $l_3$ of parasitic line 43: 60 mm The lower resonant frequency $f_L$ was 0.85 GHz and the higher resonant frequency $f_H$ was 1.53 GHz, so that the value of $f_H$ was approximately twice that of $f_L$.

Figure 14:
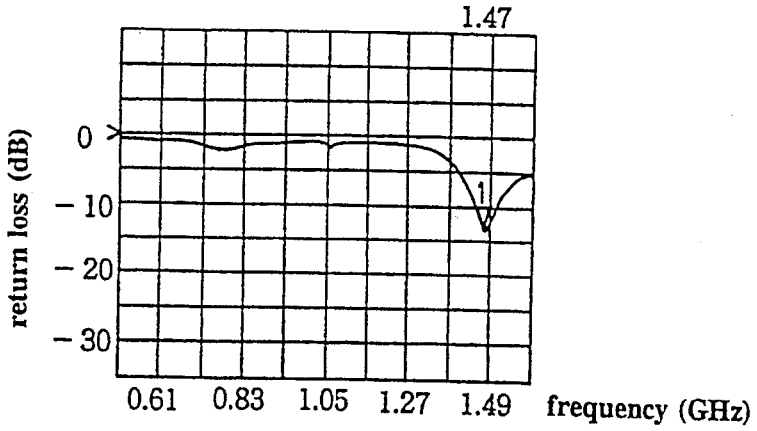
FIG. 14 shows the measured return loss characteristics when, as a comparison, the first parasitic line is not connected.
Figure 15:
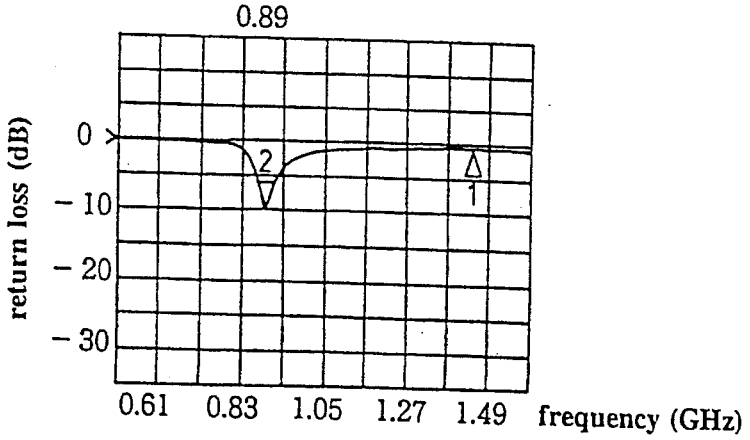
FIG. 15 shows the measured return loss characteristics when, as a comparison, the second and third parasitic lines are not connected.

In comparison, FIG. 14 shows the measured return loss characteristics when parasitic line 41 was not connected, while FIG. 15 shows the measured return loss characteristics when parasitic lines 42 and 43 were not connected. When parasitic line 41 is not connected, a resonance point appears at a frequency approximately equal to the higher resonant frequency $f_H$, and there is no resonance at all at the lower resonant frequency $f_L$. When parasitic lines 42 and 43 are not connected, a resonance point appears at a frequency approximately equal to the lower resonant frequency $f_L$, and there is no resonance at all at the higher resonant frequency $f_H$.

It will be seen from these results that parasitic line 41 operates as a short-circuited line at the lower resonant frequency $f_L$ and as an open-circuit (i.e., as if nothing were connected) at the higher resonant frequency $f_H$, while parasitic lines 42 and 43 operate as open-circuits at the lower resonant frequency $f_L$ and as short-circuited lines at the higher resonant frequency $f_H$.

Figure 16:
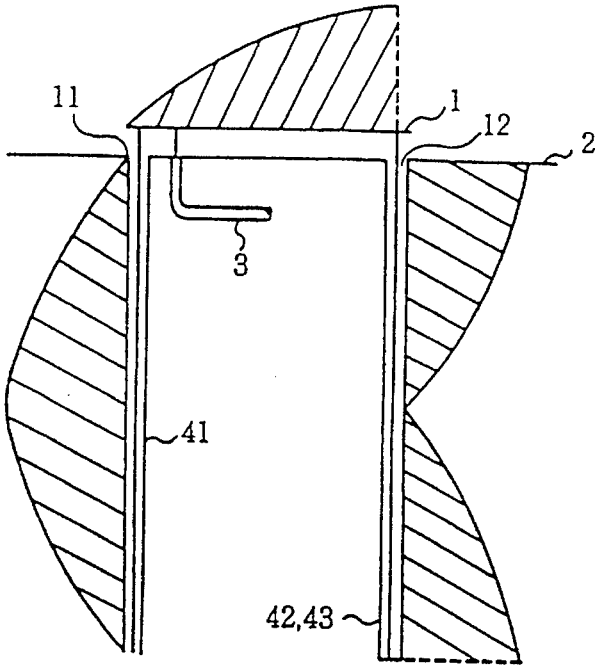
FIG. 16 serves to explain the operating principles, showing the current distributions in the third embodiment at the higher resonant frequency $f_H$.
Figure 17:
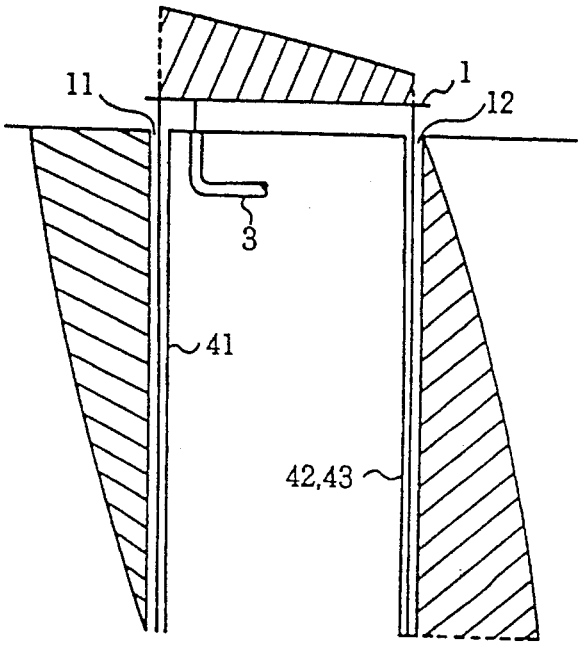
FIG. 17 serves to explain the operating principles, showing the current distributions in the third embodiment at the lower resonant frequency $f_L$.

FIG. 16 and FIG. 17 show this in terms of current distributions, with FIG. 16 indicating current distributions at the higher resonant frequency $f_H$ and FIG. 17 showing them at the lower resonant frequency $f_L$.

At the higher resonant frequency $f_H$, a 1/4-wavelength current distribution is produced on planar radiation element 1, as in a quarter-wavelength microstrip antenna, while a 1/2-wavelength current distribution is produced in parasitic line 41. The current distributions produced in parasitic lines 42 and 43 have antinodes at both ends and a node in the middle. Given these current distributions, parasitic line 41 constitutes a 1/2-wavelength selectively open line and operates as an open-circuit even at contact point 11. Parasitic lines 42 and 43 constitute 1/2-wavelength end short-circuited lines and operate as short-circuits at contact points 12. This antenna device therefore operates as a quarter-wavelength microstrip antenna. Under these circumstances, the currents on the non-grounded conductors within parasitic lines 41–43 do not radiate at all, since opposing currents are established in the surrounding grounded conductors, and so antenna operation is not hindered.

At the lower resonant frequency $f_L$, because the wavelength is doubled, a 1/4-wavelength current distribution is produced on planar radiation element 1, and 1/4-wavelength current distributions are produced in parasitic lines 41–43 as well. Given these current distributions, parasitic line 41 becomes an approximately 1/2-wavelength open-circuit line and operates as a short-circuit at contact point 11 of parasitic line 41, while parasitic lines 42 and 43 become approximately 1/4-wavelength short-circuited lines and operate as open-circuits at contact points 12. This antenna device therefore constitutes a planar inverted-F antenna which is short-circuited at the contact points of parasitic line 41 with the planar radiation element and the ground plane. In this case as well, the currents in parasitic lines 41–43 do not radiate at all and therefore do not hinder the operation of the antenna.

Because a quarter-wavelength microstrip antenna will resonate when the length of the planar radiation element is approximately a quarter wavelength, the resonant frequency of a microstrip antenna with a 40 mm long planar radiation element can be calculated to be 1.9 GHz. This value is fairly close to the higher resonant frequency $f_H$ shown in FIG. 13. On the other hand, because a general planar inverted-F antenna will resonate when the sum of the length and breadth of the planar radiation element comes to approximately a quarter wavelength, the resonant frequency of a planar inverted-F antenna where the sum of the length and breadth of the planar radiation element is 80 mm can be calculated to be 0.94 GHz. This is fairly close to the lower resonant frequency $f_L$ shown in FIG. 13. From these results it may be inferred that the foregoing consideration of operating principles is correct.

When this antenna device operates as a quarter-wavelength microstrip antenna, parasitic lines 42 and 43 act as short-circuited lines and determine the resonant wavelength. Under these circumstances, it is possible to fine tune the resonant frequency by using parasitic line 41 as an additional impedance. On the other hand, when this antenna device operates as a planar inverted-F antenna, parasitic line 41 acts as a short-circuited line and determines the resonant frequency, so that the resonant frequency can be fine-tuned by using parasitic lines 42 and 43 as additional impedances.

Figure 18:
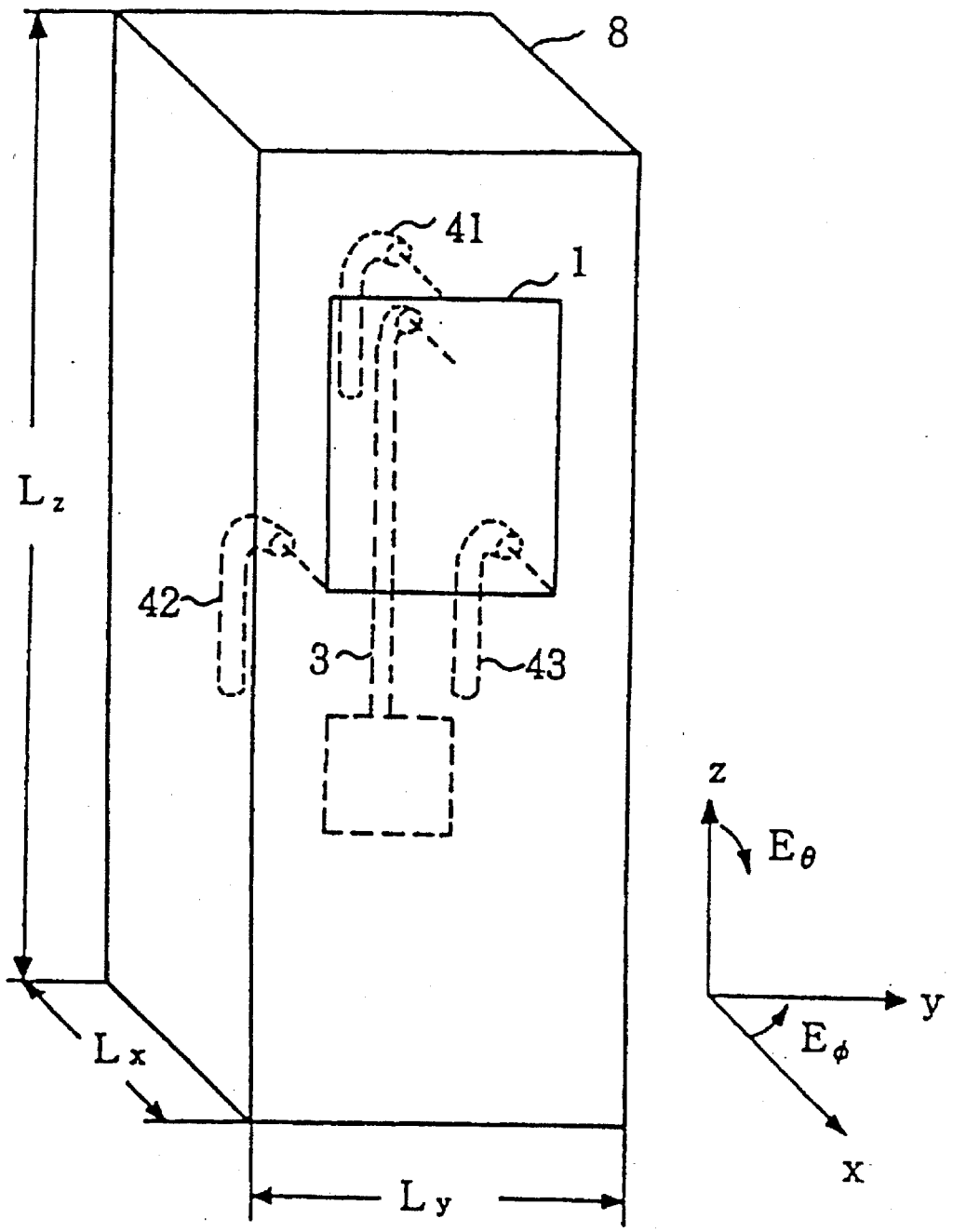
FIG. 18 is a perspective view of an antenna device according to the third embodiment fitted in an enclosure.

FIG. 18 shows the antenna device illustrated in FIG. 12 in a housing 8. In this figure, the perpendicular to planar radiation element 1 is defined as the x direction; the direction of the edge along which parasitic line 41 is set is defined as the y direction; and the direction orthogonal to these is defined as the z direction. The length of the housing in each direction is $L_x \times L_y \times L_z$. The angle of rotation around the z direction with respect to the y direction is $\phi$, and the angle of inclination from the z axis is $\theta$.

Figure 19:
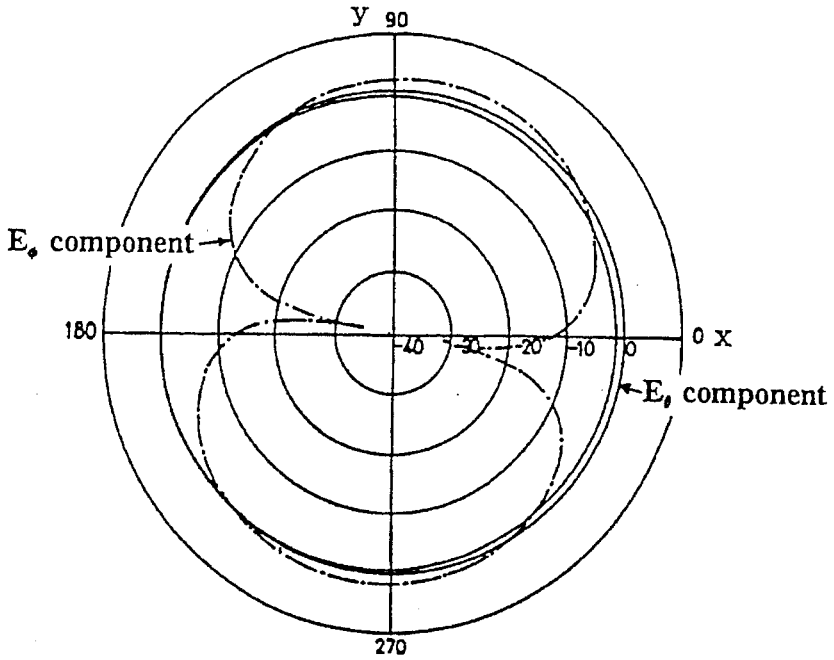
FIG. 19 shows results of measurements of the radiation pattern when $f$=1.48 GHz.
Figure 20:
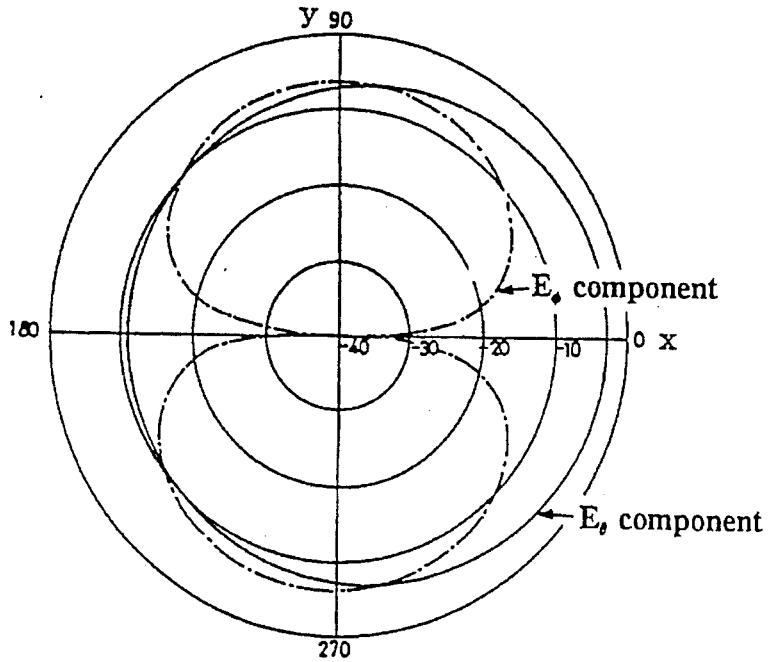
FIG. 20 shows the results of measurements of the radiation pattern when $f$=0.82 GHz.

FIG. 19 and FIG. 20 show radiation patterns when an antenna device was fitted on the y-z face of housing 8 where $L_x \times L_y \times L_z = 18 \times 40 \times 130$ mm. The dotted-and-dashed line indicates $E_\phi$ component, while the solid line indicates the $E_\theta$ component. FIG. 19 gives the results of measurements made at $f$=1.48 GHz, while FIG. 20 gives the results of measurements made at $f$=0.82 GHz. As will be clear from these figures, this antenna device has a non-directive radiation pattern and is practical.

In the embodiment described above, although the electrical lengths of parasitic lines 41–43 were set to approximately 1/4 of the wavelength of the lower resonant frequency, this invention can be similarly implemented with these electrical lengths set to 3/4, 5/4, . . . 1/4+m/2 (where m is an integer equal to or greater than 0). In addition, neither the positions of the contact points of the parasitic lines, nor the shape of the planar radiation element are restricted to those given in the embodiment, and provided that the first parasitic line becomes short-circuited at the lower resonant frequency and open-circuited at the higher resonant frequency, and that the second and third parasitic lines become open-circuited at the lower resonant frequency and short-circuited at the higher resonant frequency, the parasitic lines and the feed line can be connected to other places and planar radiation elements of other shapes can be used.

Furthermore, although the foregoing embodiments employed either one or three parasitic lines, the number of parasitic lines is not restricted to these numbers, and provided that the distinguishing feature of this invention is utilized, namely, that a parasitic line becomes open at one frequency and short-circuited at a second frequency, this invention can be similarly implemented using more parasitic lines.

As has been explained above, this invention has the effect of enabling double-resonance characteristics to be obtained by means of an antenna device with a simple construction and a volume which is the same as that of a small single planar antenna.

As has been explained above, an antenna device according to this invention, despite being of approximately the same volume as a planar inverted-F antenna operating at a given frequency, can resonate not just at that resonant frequency but also at a resonant frequency which is approximately twice that, so that double-resonance characteristics—for example, 800 MHz and 1500 MHz—can be obtained. Moreover, its construction is simple and it is inexpensive to produce.

We claim:

1. An antenna device having double resonance characteristics, comprising:

a conductive ground plane;

a conductive planar radiation element arranged approximately parallel to said conductive ground plane, said conductive planar radiation element having a substantially rectangular shape;

an insulator between said conductive ground plane and said conductive planar radiation element;

a feed line having a grounded conductor connected to said conductive ground plane and a non-grounded conductor connected to said conductive planar radiation element at a first contact point;

a parasitic line having a grounded conductor connected to said conductive ground plane and a non-grounded conductor connected to said conductive planar radiation element at second contact point a distance from said first contact point, a terminal end of said parasitic line being open-circuited, said parasitic line being located at a first end of said conductive planar radiation element at approximately a middle of one of two mutually opposing edges of said conductive planar radiation element; and λ being a resonant wavelength of said antenna device when said grounded conductor and said non-grounded conductor of said parasitic line are short-circuited, an electrical length of said parasitic line being:

$$(1/4+m/2)\times\lambda$$

where m is an integer equal to or greater than 0;

said antenna device having a higher resonant frequency and a lower resonant frequency equal to about half of said higher resonant frequency; and said parasitic line appearing as an open-circuit at said higher resonant frequency and as a closed-circuit at said lower resonant frequency.

2. An antenna device having double resonance characteristics, comprising:

a conductive ground plane;

a conductive planar radiation element arranged approximately parallel to said conductive ground plane, said conductive planar radiation element having a substantially rectangular shape;

an insulator between said conductive ground plane and said conductive planar radiation element;

a feed line having a grounded conductor connected to said conductive ground plane and a non-grounded conductor connected to said conductive planar radiation element at a first contact point;

a parasitic line having a grounded conductor connected to said conductive ground plane and a non-grounded conductor connected to said conductive planar radiation element at second contact point a distance from said first contact point, said parasitic line being located at a first end of said conductive planar radiation element at approximately a middle of one of two mutually opposing edges of said conductive planar radiation element; and a first slit provided in a first edge of said conductive planar radiation element;

said antenna device having a higher resonant frequency and a lower resonant frequency equal to about half of said higher resonant frequency;

said parasitic line appearing as an open-circuit at said higher resonant frequency and as a closed-circuit at said lower resonant frequency; and said first slit tuning said lower resonant frequency of said antenna device.

3. An antenna device comprising:

a conductive ground plane;

a conductive planar radiation element arranged approximately parallel to said conductive ground plane, said conductive planar radiation element having at least two mutually opposing edges;

an insulator between said conductive ground plane and said conductive planar radiation element;

a feed line having a grounded conductor connected to said conductive ground plane and a non-grounded conductor connected to said conductive planar radiation element at a first contact point;

a first parasitic line having a grounded conductor connected to said conductive ground plane and a non-grounded conductor connected at a first end to said conductive planar radiation element at approximately a middle of one of said at least two mutually opposing edges of said conductive planar radiation element and at a distance from said first contact point of said non-grounded conductor of said feed line;

a second parasitic line and a third parasitic line each having a respective contact point to said conductive planar radiation element at a respective corner of said conductive planar radiation element, said respective corners including edges of said conductive planar radiation element other than said at least two mutually opposing edges;

λ being a resonant wavelength of said antenna device when said conductive planar radiation element is short-circuited to said conductive ground plane other than by said first parasitic line, and when said second parasitic line and said third parasitic line are not present, respective electrical lengths of said first parasitic line, said second parasitic line, and said third parasitic line being set so as to be approximately equal to a value given by:

$(1/4+m/2)\times\lambda$ where m is an integer which is equal to or greater than 0 and which is established independently for each of said first parasitic line, said second parasitic line, and said third parasitic line;

a terminal end of said first parasitic line being open-circuited; and respective terminal ends of said second parasitic line and said third parasitic line are short-circuited.

4. An antenna device having double resonance characteristics according to claim 3, wherein:

said antenna device has a higher resonant frequency and a lower resonant frequency equal to about half of said higher resonant frequency, said first parasitic line appearing as an open-circuit at said higher resonant frequency and as a closed-circuit at said lower resonant frequency.

5. An antenna device having double resonance characteristics according to claim 3, wherein:

said conductive planar radiation element operates as a quarter-wavelength microstrip antenna at said higher resonant frequency; and said antenna device operates as a planar inverted-F antenna at said lower resonant frequency, said lower resonant frequency being related to a length of a periphery of said conductive planar radiation element.

6. An antenna device having double resonance characteristics according to claim 2, further comprising:

a second slit formed in a second edge of said conductive planar radiation element mutually opposing said first edge of said conductive planar radiation element;

said conductive planar radiation element operating as a microstrip-antenna at said higher resonant frequency, said first slit and said second slit not affecting said higher resonant frequency; and said antenna device operating as a planar inverted-F antenna at said lower resonant frequency, said lower resonant frequency being related to a length of a periphery of said conductive planar radiation element, said first slit and said second slit increasing said periphery of said conductive planar radiation element and thus tuning said lower resonant frequency of said antenna device.

* * * * *